US010076205B2

(12) United States Patent
Weir

(10) Patent No.: US 10,076,205 B2
(45) Date of Patent: Sep. 18, 2018

(54) COMMUNION TRAY HAVING CORNER CUP DISPOSAL OPENINGS

(71) Applicant: Dennis Douglas Weir, Provo, UT (US)

(72) Inventor: Dennis Douglas Weir, Provo, UT (US)

( * ) Notice: Subject to any disclaimer, the term of this patent is extended or adjusted under 35 U.S.C. 154(b) by 0 days.

(21) Appl. No.: 15/413,597

(22) Filed: Jan. 24, 2017

(65) Prior Publication Data

US 2018/0206662 A1 Jul. 26, 2018

(51) Int. Cl.
*A47G 23/06* (2006.01)
*A47G 33/00* (2006.01)

(52) U.S. Cl.
CPC ..... *A47G 33/00* (2013.01); *A47G 23/0633* (2013.01); *A47G 23/0641* (2013.01)

(58) Field of Classification Search
CPC ..... A47G 23/0633; A47G 23/0641; A47G 33/00; A47G 33/02; A47G 33/06; B65D 77/00; B65D 77/26
USPC ..... 206/19, 557–567; D7/552.1
See application file for complete search history.

(56) References Cited

U.S. PATENT DOCUMENTS 1,954,224 A * 4/1934 Piker ..... B25H 3/06 206/561
2,711,089 A * 6/1955 Dingeldein ..... A47G 33/00 206/564
2,728,484 A * 12/1955 Farrington ..... B65D 71/004 206/562
2,853,349 A * 9/1958 Wilcox ..... A47G 33/00 206/19
2,981,039 A * 4/1961 Pohl ..... B65B 43/08 206/562
3,025,948 A * 3/1962 Appelt ..... A47J 47/14 206/563
3,101,864 A * 8/1963 Glickman ..... B65D 1/34 206/557
5,271,496 A * 12/1993 Cain ..... A47G 33/00 206/19
5,314,060 A * 5/1994 Cain ..... A47G 33/00 206/563
5,979,646 A * 11/1999 Strachan ..... B65D 71/70 206/562

FOREIGN PATENT DOCUMENTS

GB 244030 A * 12/1925 ..... A47G 33/02

* cited by examiner

*Primary Examiner* — Bryon Gehman
(74) *Attorney, Agent, or Firm* — Angus C. Fox, III

(57) ABSTRACT

The present invention solves the problem of possible contamination of unconsumed liquid contained by communion cups that remain in the circular apertures of the cup array of the tray cover. The problem has been solved by moving the empty cup disposal openings from their current central locations in the tray cover to the four corners thereof. The new configuration makes it awkward for a congregant to dispose of his cup by reaching over cups containing unconsumed liquid. Although the improved tray cover is configured to hold 34 cups rather than 36, the loss of capacity of 2 cups is considered to be an acceptable compromise for decreasing the spread of disease causing organisms.

12 Claims, 7 Drawing Sheets

COMMUNION TRAY HAVING CORNER CUP DISPOSAL OPENINGS

FIELD OF THE INVENTION

This invention relates to communion distribution trays and, more particularly, to an improved tray configuration for miniature disposable cups that are filled with liquid for distribution to congregants.

BACKGROUND OF THE INVENTION

In many Christian religious services, small communion cups containing wine, grape juice, water, or the like and small quantities of bread are distributed to the participants. A wide variety of communion trays have been developed over the years for this purpose.

The Church of Jesus Christ of Latter-day Saints (a.k.a., the Mormon Church) makes available to its congregations bread and water communion distribution trays of standardized design. Although in the past, trays fabricated from stainless steel were available, only trays made primarily of polymeric engineering thermoplastic resins are currently available. As there have been no complaints with respect to the standard bread distribution tray design, the present invention relates, specifically, to modifications of the standard water distribution tray. The water distribution tray that is currently in use is made of three thermoplastic components: a tray bottom having a floor and a perimetric wall used to hold discarded miniature drinking cups; a U-shaped handle that is secured to the floor of the tray bottom; and a tray cover, having a downward facing perimetric rim, that fits over the U-shaped handle and snaps onto the upper edges of the perimetric wall. The tray cover incorporates an array of some three dozen circular apertures, each of which is sized to hold a standard-size miniature drinking cup. Normally, each congregant takes a filled cup, drinks the contents, and then discards the empty cup into the tray through large openings in the array that are positioned in line with the handle, at each end of the array and in the center of the array between the handle. The tray cover, as currently provided to congregations, is configured such that there are two rows of nine apertures each on each side of the handle.

Referring now to Figure, in this top view of a communion tray cover that is currently in use, one can see thirty-six circular cup retaining apertures 101 and three centrally-positioned empty cup disposal apertures 102-A, 102-B and 102-C. One of the problems associated with the design of tray cover 100 that is currently in use is that as congregants dispose of empty cups into the central openings of the array, drips from those cups can fall into cups containing unconsumed liquid that remain in the circular apertures of the cup array of the tray cover. Given that some of the congregants are invariably sick and capable of communicating their sicknesses to others, the distribution of communion provides an opportunity for the spread of infectious diseases. During the polio epidemic of the early 1900s, this could have been a significant vector in the spread of the disease. Although polio has since been controlled, and infections of the common cold and flu are the ones most likely to be transmitted to others, there is no reason why this vector should not be eliminated altogether. After all, it is not known when a virus or bacterium will mutate and become the cause of a serious epidemic.

What is needed is a new cup array configuration for the tray cover that will reduce the probability that infectious diseases will be spread from infected congregants to those who are uninfected.

SUMMARY OF THE INVENTION

The present invention solves the problem of possible contamination of unconsumed liquid contained by communion cups that remain in the circular apertures of the cup array of the tray cover. The problem has been solved by moving the empty cup disposal openings from their current central locations in the tray cover to the four corners thereof. Such a configuration makes it awkward for a congregant to dispose of his cup by reaching over cups containing unconsumed liquid. Although the improved tray cover is configured to hold 34 cups rather than 36, the loss of capacity of 2 cups is considered to be an acceptable tradeoff for decreasing the spread of disease causing organisms.

PREFERRED EMBODIMENT OF THE INVENTION

The invention will now be described with reference to the attached drawing figures. It should be understood that the drawings may not be drawn to exact scale and are intended to be merely illustrative of the invention.

Figure 1:
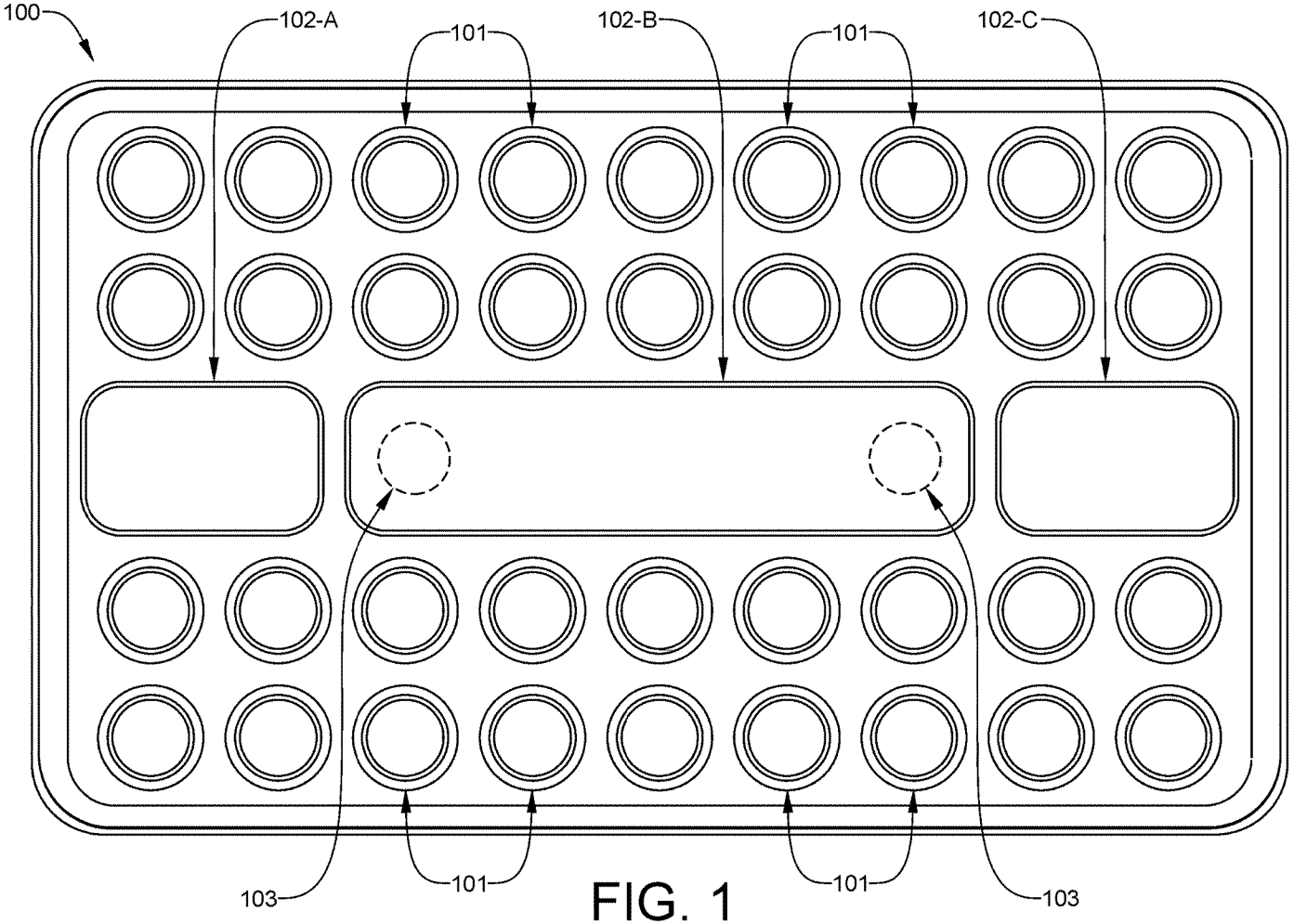
FIG. 1 (PRIOR ART)
FIG. 1 is a top plan view of a prior art communion tray cover.
Figure 2:
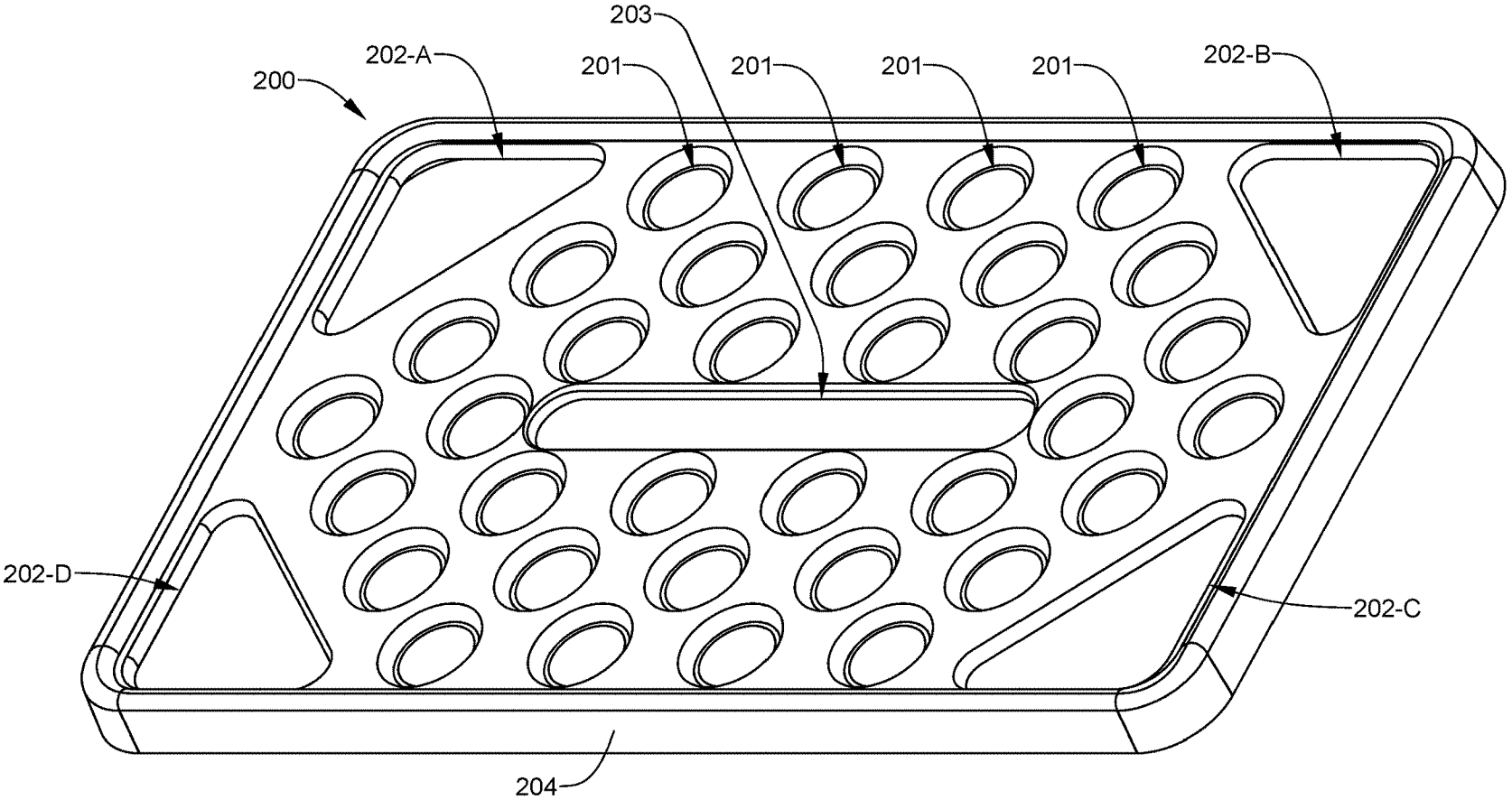
FIG. 2 is an isometric view of the new injection molded communion tray cover.
Figure 3:
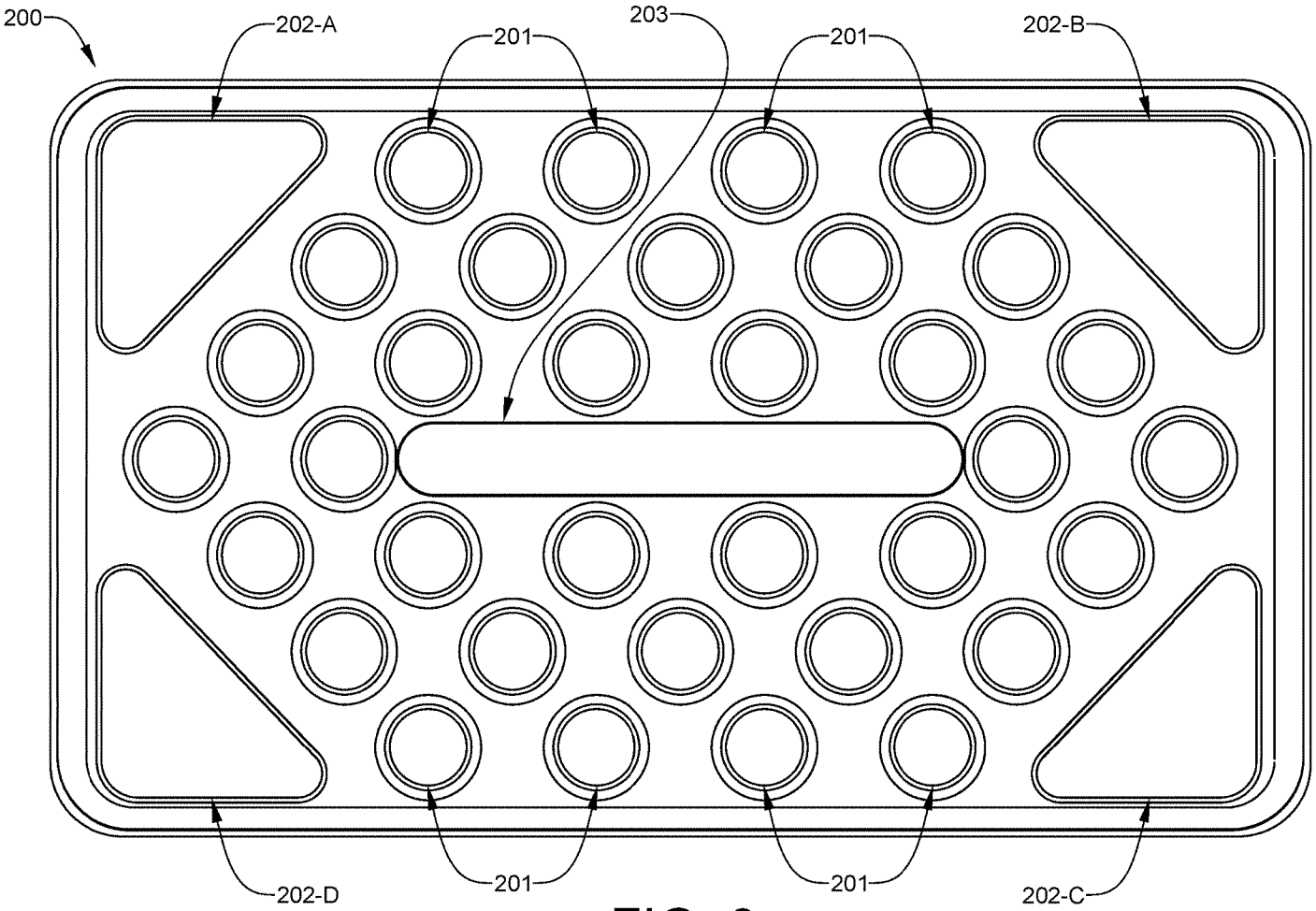
FIG. 3 is a top plan view of the new injection molded communion tray cover.

Referring now to FIGS. 2 and 3, the new tray cover 200 is injection molded from one of several engineering polymer thermoplastics that is approved for use with food. The new tray cover 200 incorporates thirty-four circular apertures 201, each of which holds a communion cup filled with liquid. It will be noted that whereas the prior art communion water tray cover had cup disposal openings in the center of the tray—at the ends and beneath the handle—this new tray cover 200 has four cup disposal openings 202-A, 202-B, 202-C and 202-D—each opening positioned at one of the four corners of the generally rectangular tray cover 200. The tray cover 200 is described as being of generally rectangular shape because the four corners have been rounded to relieve stress that results from square corners. The most tragic examples of stress-related failure of rectangular objects are likely the crashes of two De Havilland Comet commercial jet aircraft in the mid 1950s that, after extensive testing, were ultimately attributed to metal fatigue caused by stress at the corners of the aircraft's square windows. The rounded corners of the tray cover 200 are more able to distribute structural loads when corners are bumped into solid objects or when the tray covers are subjected to changes in temperature. Rounded corners are also easier to clean than square corners. The central oblong aperture 203 in the center of the tray 200, which is too narrow for disposal of empty cups, fits over the handle (see FIGS. 6 and 7). The tray cover 200 is equipped with a downwardly-projecting perimetric flange 204. The new tray cover 200 is bilaterally symmetrical about both its longitudinal axis and its lateral axis.

Figure 4:
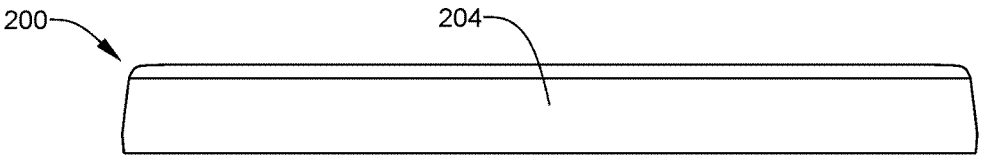
FIG. 4 is an elevational lateral side view of the new injection molded communion tray cover.

Referring now to FIG. 4, the new tray cover 200 is seen in an end view. As the tray cover 200 is bilaterally symmetrical about its lateral axis, both ends are indistinguishable from one another.

Figure 5:
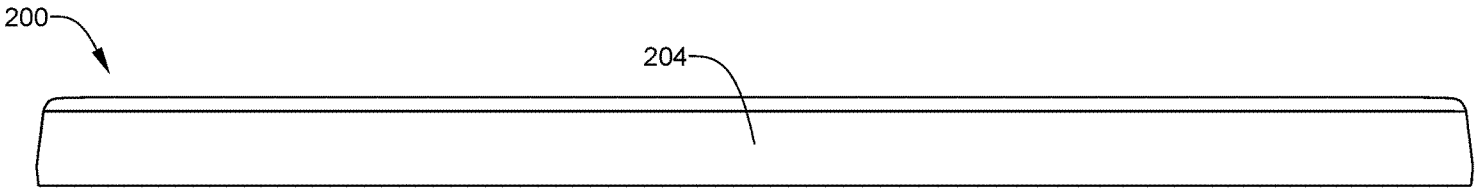
FIG. 5 is an elevational longitudinal side view of the new injection molded communion tray cover.

Referring now to FIG. 5, the new tray cover 200 is seen in a side view. As the tray cover 200 is also bilaterally symmetrical about its longitudinal axis, both sides are indistinguishable from one another.

Figure 6:
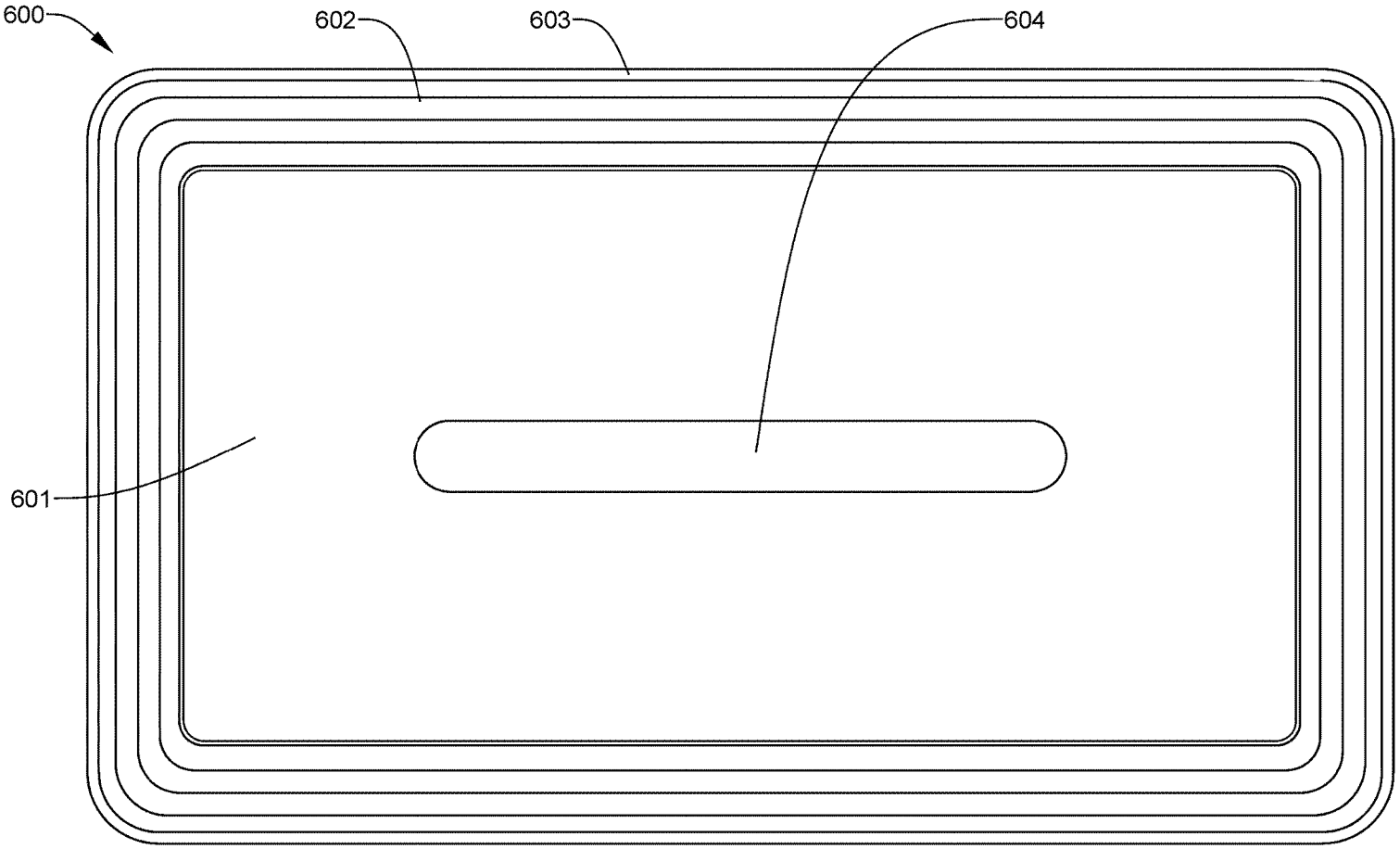
FIG. 6 is a top plan view of the tray bottom and attached handle.

Referring now to FIG. 6, the tray bottom 600 is seen from the top. The tray bottom 600 includes a floor 601, a surrounding and upwardly-extending perimetric wall 602, and a perimetric edge 603 atop the perimetric wall 602. Both ends of a U-shaped handle 604 are secured to the floor 601 with threaded fasteners (not shown).

Figure 7:
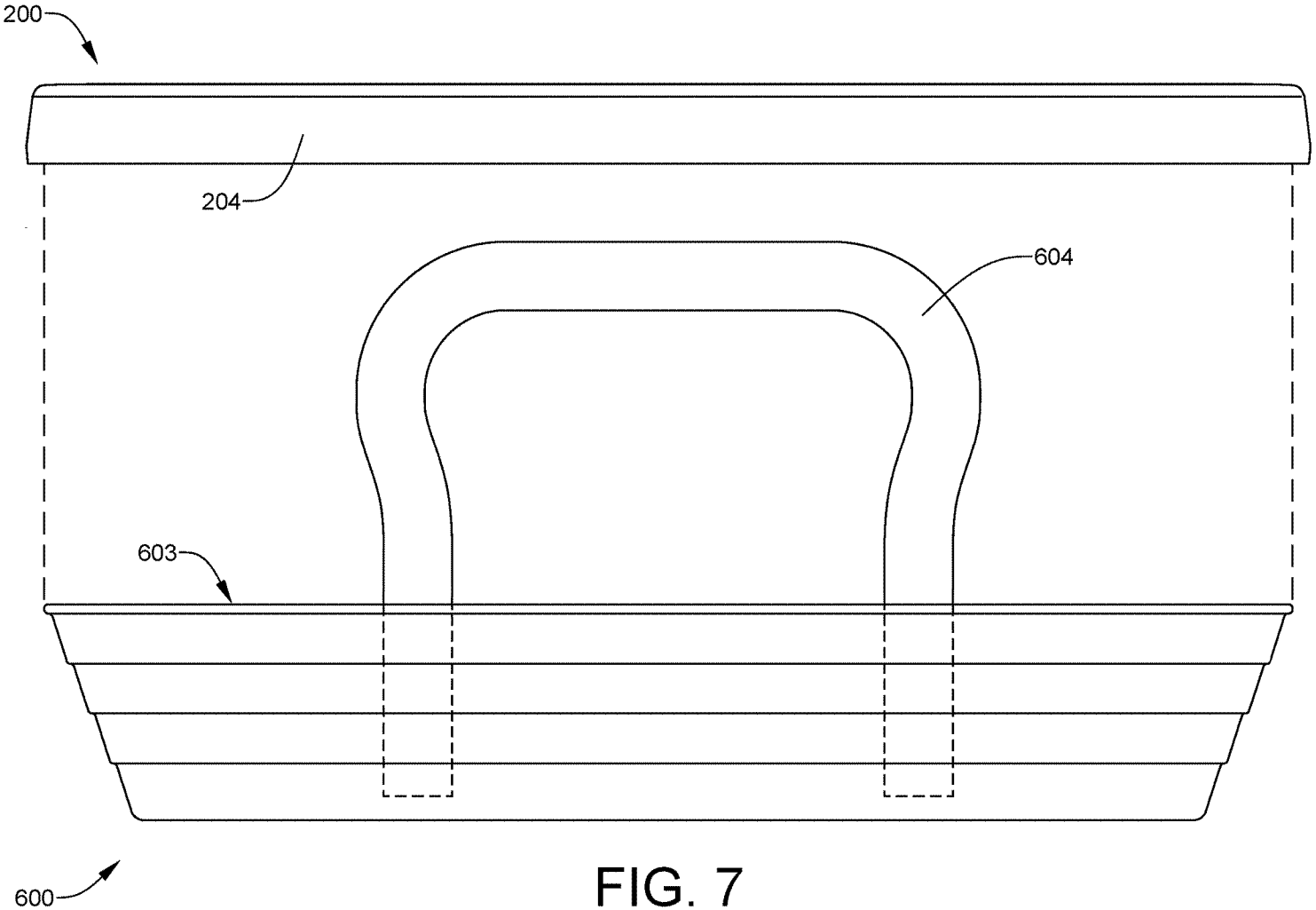
FIG. 7 is an elevational longitudinal side view of the new injection molded communion tray cover positioned above the lower tray tray bottom and ready to be installed thereon.
Figure 8:
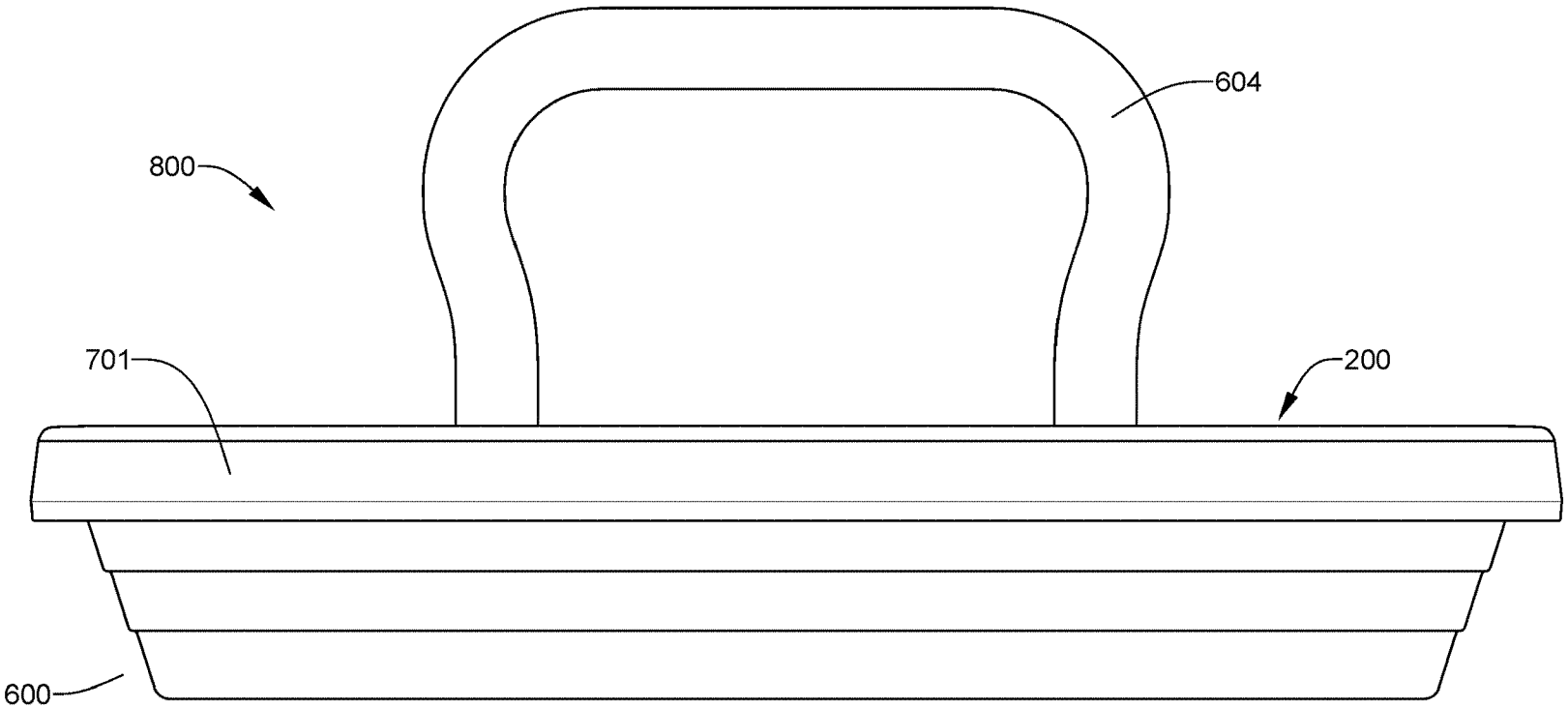
FIG. 8 is an elevational longitudinal side view of the new injection molded communion tray cover after it has been slipped over the U-shaped handle and snapped over the upper edges of the perimetric wall of the tray bottom.

Referring now to FIG. 7, the new tray cover 200 is shown elevated above the tray bottom 600, to which the U-shaped handle 604 is secured.

Referring now to FIG. 7, the U-shaped handle 601 has been inserted through the oblong opening 202, and the perimetric flange 204 of the new tray cover 200 have been snapped over the upper perimetric edge 603 of the tray bottom 600, thereby completing the assembly of the new communion water tray 700. It should be evident that each of the four cup disposal openings 202-A, 202-B, 202-C and 202-D communicates with the chamber that is created by the floor 601 and perimetric wall 602 of the tray bottom 600 when the tray cover 200 is atop the tray bottom 600.

Although only a single embodiment of the injection molded water distribution communion tray has have been shown and described, it will be obvious to those having ordinary skill in the art that changes and modifications may be made thereto without departing from the scope and the spirit of the invention as hereinafter claimed.

What is claimed is:

1. A liquid distribution communion tray comprising:

a unitary tray bottom having a floor, an upwardly-extending perimetric wall, and a perimetric edge atop the perimetric wall;

a handle secured to the floor; and a generally rectangular tray cover having a plurality of apertures for receiving a plurality of liquid filled miniature drinking cups, an empty cup disposal opening at each corner of the tray cover, a central oblong aperture that fits over the handle, and a downwardly-projecting perimetric flange that fits over the perimetric edge atop the perimetric wall.

2. The liquid distribution communion tray of claim 1, wherein each of the corners of the generally rectangular tray cover is rounded.

3. The liquid distribution communion tray of claim 1, where the handle is generally U-shaped, and both ends thereof are secured to the floor.

4. The liquid distribution communion tray of claim 1, wherein the central oblong aperture is too narrow for empty miniature drinking cups to pass through it.

5. The liquid distribution communion tray of claim 1, wherein said downwardly-projecting perimetric flange snaps over the perimetric edge atop the perimetric wall.

6. The liquid distribution communion tray of claim 1, wherein said tray bottom and said tray cover are made of an injection-molded polymeric engineering thermoplastic resin approved for use with food products.

7. A liquid distribution communion tray comprising:

a unitary lower tray having a floor and an upwardly-extending perimetric wall;

a handle secured to the floor; and a tray cover having a plurality of apertures for receiving a plurality of liquid filled miniature drinking cups, an empty cup disposal opening at each corner of the tray cover, and a central aperture that fits over the handle.

8. The liquid distribution communion tray of claim 7, where the handle is generally U-shaped, and both ends thereof are secured to the floor.

9. The liquid distribution communion tray of claim 7, wherein said tray cover is generally rectangularly shaped, and each of the corners thereof is rounded.

10. The liquid distribution communion tray of claim 7, wherein the central aperture that fits over the handle is oblong and too narrow for empty cups to pass through it.

11. The liquid distribution communion tray of claim 10, wherein the tray cover has a downward-projecting perimetric flange, which can be snapped over an upper edge of the perimetric wall.

12. The liquid distribution communion tray of claim 7, wherein said tray bottom and said tray cover are made of an injection-molded polymeric engineering thermoplastic resin approved for use with food products.

* * * * *